US006966203B2

(12) United States Patent
Matsuda et al.

(10) Patent No.: US 6,966,203 B2
(45) Date of Patent: Nov. 22, 2005

(54) WASHING-DRYING MACHINE

(75) Inventors: Eiji Matsuda, Hyogo (JP); Tadashi Inuzuka, Hyogo (JP); Kimura Kyosuke, Hyogo (JP); Kazutoshi Adachi, Hyogo (JP); Hiroshi Isago, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 565 days.

(21) Appl. No.: 10/161,672

(22) Filed: Jun. 5, 2002

(65) Prior Publication Data

US 2002/0178765 A1 Dec. 5, 2002

(30) Foreign Application Priority Data

Jun. 5, 2001 (JP) ..... 2001-169227

(51) Int. Cl.[7] ..... D06F 25/00; D06F 33/00

(52) U.S. Cl. ..... 68/12.15; 68/20; 34/75; 34/77

(58) Field of Search ..... 68/20, 19.2, 12.14, 68/12.15, 12.21, 12.22, 12.23; 34/73, 75, 77, 78

(56) References Cited

U.S. PATENT DOCUMENTS 4,154,003 A * 5/1979 Muller ..... 34/469
5,111,673 A * 5/1992 Kadoya et al. ..... 68/12.04
6,665,953 B2 * 12/2003 Woo et al. ..... 34/527
2002/0100298 A1 * 8/2002 Jeong et al. ..... 68/20

FOREIGN PATENT DOCUMENTS

| | | |
|---|---|---|
| EP | 0 829 569 | 3/1998 |
| JP | 6-218197 | 8/1994 |
| JP | 10-085497 | 4/1998 |
| JP | 2001-129287 | 5/2001 |

* cited by examiner

*Primary Examiner*—Joseph L Perrin
(74) *Attorney, Agent, or Firm*—Wenderoth, Lind & Ponack, L.L.P.

(57) ABSTRACT

A washing-drying machine includes an inner tub having a rotating shaft and sustained rotatably in an outer tub suspended elastically in a cabinet, where an agitator disposed rotatably on an inner bottom of the inner tub. The washing-drying machine also includes a motor for driving the inner tub or the agitator and a warm-air-circulating pass having a heat exchanger cooled by a cooling section. The washing-drying machine further includes a controller for controlling processes including washing, rinsing, dehydrating and drying. The cooling section is formed of a water-cooling-section for cooling warm-air in the heat exchanger by supplying water, and an air-cooling-section for cooling an outer wall of the heat exchanger by blowing air. As a result, high dehumidification rate by improving heat-exchange efficiency of the heat can be obtained, and clothes are hardly damaged and electric power and the amount of water consumption can be saved.

12 Claims, 9 Drawing Sheets

Fig.4—1
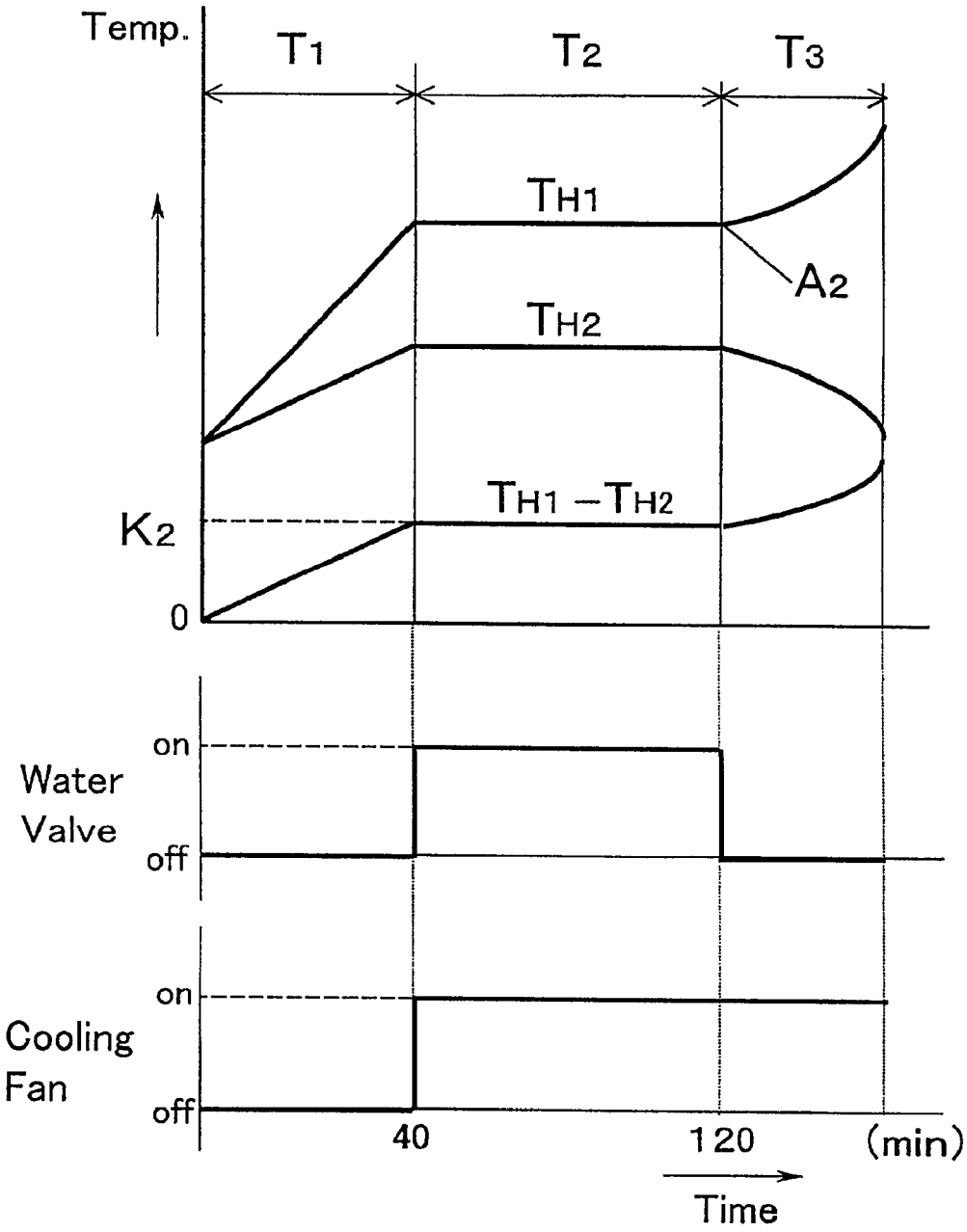

Fig.4−2
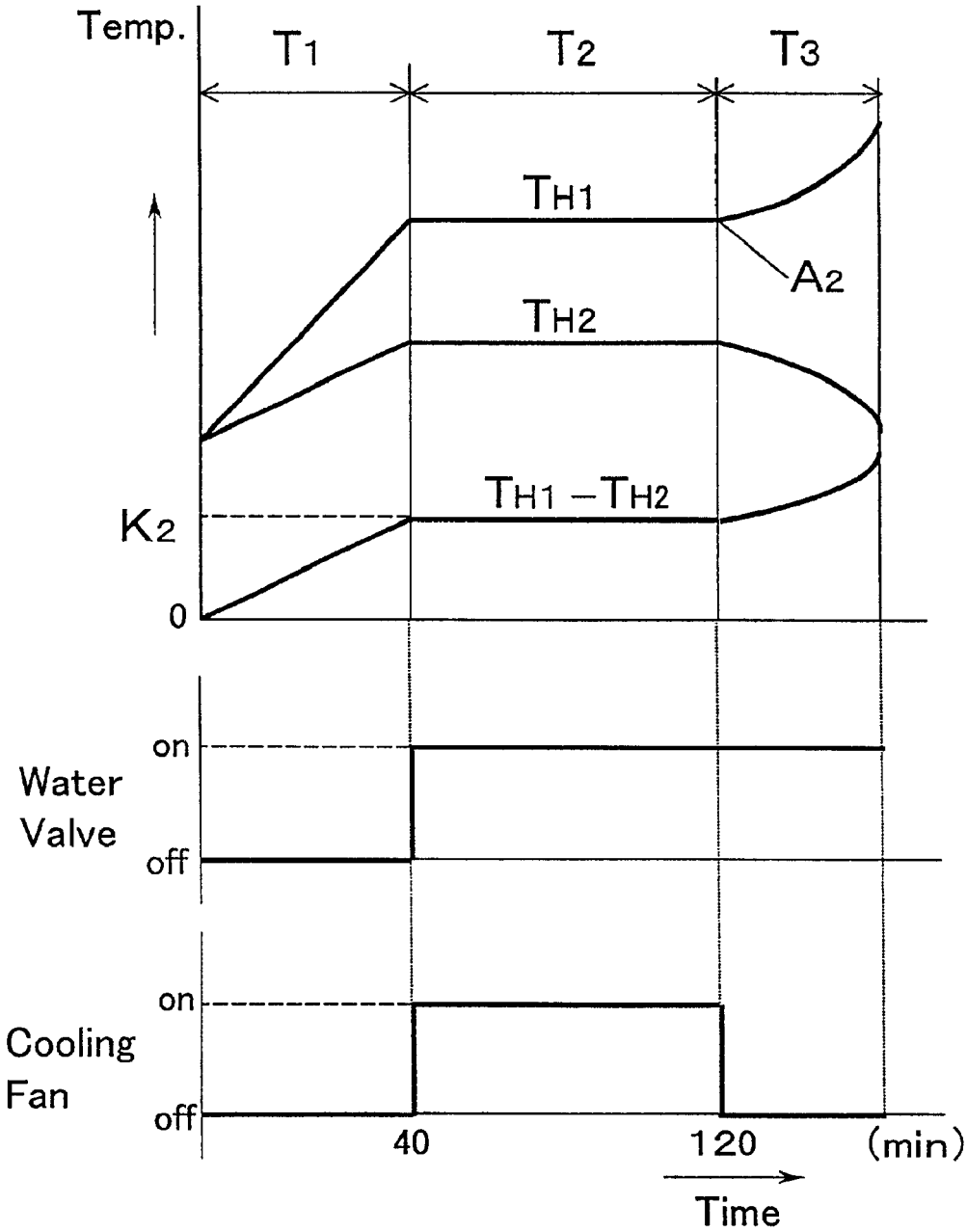

WASHING-DRYING MACHINE

FIELD OF THE INVENTION

The present invention relates to a washing-drying machine which can control sequential processes i.e., washing, rinsing, dehydrating and drying.

BACKGROUND OF THE INVENTION

A conventional washing-drying machine is disclosed in Japanese Patent Application Non-Examined Publication No. 2001-129287, and has a structure as shown in FIG. 7. As shown in FIG. 7, suspended outer tub 3 is placed in cabinet 1 using suspension 2 which absorbs vibration. Inner tub 4 used for accommodating clothes (articles for washing or drying) is disposed in outer tub 3, and can rotate about the center of shaft 5 for washing and spin-drying (dehydrating). Agitator 6 is rotatably disposed on the inner bottom of inner tub 4, and agitates the clothes (articles for washing or drying). Fluid balancer 7 is disposed on an upper part of inner tub 4. Protrusion 9 for agitating is formed on a dishlike base having slope 8 at its circumference, whereby agitator 6 is formed. Motor 10 is disposed under outer tub 3 and coupled with inner tub 4 or agitator 6 via clutch 11 and shaft 5.

One end of heat exchanger 12 is coupled with the lower part of outer tub 3 via lower-accordion-hose 13, and another end of heat exchanger 12 is coupled with one end of air blower 14 for drying. Another end of air blower 14 is coupled with warm-air supplying pass 16 having heater 15, where heater 15 and air blower 14 form a warm-air blowing section. Pass 16 leads to inner tub 4 via upper-accordion-hose 17. As a result, warm air is circulated through warm-air circulating pass 18 in the washing machine, where warm-air circulating pass 18 is formed by the hoses, the pass and so on.

Outer tub cover 19 is disposed on an upper surface of outer tub 3. Warm-air-spouting opening 20, which is connected with upper-accordion-hose 17, is punched on cover 19. Inner lid 21 used for putting in or taking out the clothes is formed on cover 19. Cabinet cover 22 covering an upper surface of cabinet 1 has outer lid 23, operational display section 24 and water valve 25 for supplying water into inner tub 4. Drain valve 26 for draining water from outer tub 3 is disposed on the bottom of outer tub 3. Air blower 27 for cooling is disposed on the side of cabinet 1, and cools outer tub 3 and heat exchanger 12, which are placed in cabinet 1.

Controller 28, which includes a microprocessor, controls sequential processes i.e., washing, rinsing, dehydrating and drying. In the processes, controller 28 controls a drying process by inputting a detected output from thermistors 29 and 30, where thermistor 29 detects a temperature of an outer wall of heat exchanger 12, and thermistor 30 detects a temperature of circulating air at an exit of heat exchanger 12.

In the conventional washing machine discussed above, sequential processes i.e., washing, rinsing, dehydrating and drying are operated by the well-known method. The detailed descriptions of some processes i.e., washing, rinsing and dehydrating are omitted hereinafter, and only drying process is described.

In the drying process, drain valve 26 is closed, clutch 11 is shifted and rotating force of motor 10 is transmitted to agitator 6, so that the clothes are agitated by agitator 6. At the same time, warm air is sent to warm-air-spouting opening 20 using the warm-air blowing section formed of air blower 14 and heater 15, whereby drying is performed. As a result, water is evaporated from the clothes. Warm air including moisture produced from evaporation of water on the clothes moves from inner tub 4 to an inside of outer tub 3, then moves through lower-accordion-hose 13 and reaches heat exchanger 12. Since an inner wall of outer tub 3 or heat exchanger 12 is lower than the warm air in temperature, moisture condensation occurs, and moist warm air is dehumidified and returns to air blower 14. The clothes in inner tub 4 are dried circulating the warm air using warm-air circulating pass 18.

A temperature of circulating wind in the drying process changes as shown in FIG. 8. Firstly, when drying starts, a temperature of the clothes exposed to warm air increases during preheat period T1.

Secondly, inputting heat from heater 15 and latent heat of evaporating water included in the clothes achieve a state of equilibrium during period T2 referred to as a constant-rate period of drying. Then drying progresses further, and water adhered on a surface of the clothes evaporates completely.

Thirdly, water included within the clothes evaporates during period T3 referred to as a decreasing rate period of drying. Because the amount of latent heat of evaporating water becomes less than inputting heat from heater 15 during period T3, surplus inputting heat increases temperatures of the clothes and circulating wind, where a starting point of increasing a temperature is referred to as inflection point A1. Controller 28 determines inflection point A1 with a rate of change between detected temperature TH1 of thermistor 29 and detected temperature TH2 of thermistor 30. A drying rate of the clothes is approximately 90% through 95% at inflection point A1, so that a given delayed period is provided after inflection point A1 and clothes are enough dried. After that, the drying process finishes.

However, in the conventional washing-drying machine, warm-air circulating pass 18 is needed to form in a restricted space of cabinet 1, so that a sufficient cooling area for heat exchanger 12 can not be obtained. As a result, a high dehumidification rate can not be achieved, and a drying time tends to be longer. Air-cooling method mentioned above, which cools indirectly warm air circulating in heat exchanger 12, needs a large heat-exchange-area and is difficult to obtain a high cooling capacity. In addition to that, the conventional washing-drying machine as shown in FIG. 7 is difficult to agitate even a small amount of clothes, because of a top-loading type. Besides, when inner surface of inner tub 4 and outer tub 3 are wet, a time from a starting of a drying process to increases of temperatures of inner tub 4 and wet clothes in inner tub 4 becomes longer. As a result, drying becomes difficult to be detected, and drying efficiency deteriorates, so that the drying period becomes longer.

In the conventional washing-drying machine above mentioned, humidity of warm air circulating in heat exchanger 12 reaches approximately 100% during the constant-rate period of drying. However, warm air is not dehumidified by only the air-cooling method and circulates. In addition, heat-exchanging efficiency does not reach a higher level because of retention of moisture condensation adhered on an inner wall of heat exchanger 12. As drying progresses during the decreasing rate period of drying, a temperature of circulating wind increases, so that clothes, which are made of chemical fibers or the like and therefore dry fast, are over-dried. As a result, wrinkles occur in the clothes or clothes easily become damaged.

When a cooling section of heat exchanger 12 is stopped or efficiency of the cooling section deteriorates in the drying process due to trouble, the drying time is prolonged and the clothes are likely to be damaged. In this case, process time of agitating clothes by using agitator 6 becomes longer, so that wrinkles and entanglements are likely to occur in some clothes. In addition to the problem discussed above, the conventional washing-drying machine (either air-cooling method or water-cooling method) has problems, which are spending a lot of energy and amounts of water.

SUMMARY OF THE INVENTION

The present invention addresses the problems discussed above and aims to provide a washing-drying machine having following features:

(a) high dehumidification rate by improving heat-exchange efficiency of a heat exchanger, (b) high efficiency of by shortening drying time and improving drying efficiency, (c) approximately free from damage to clothes, and (d) high reliability by decreasing moisture condensation using circulating wind drained partly from an outer tub of the washing-drying machine.

The washing-drying machine of this invention includes the following elements:

(a) a cabinet (b) an outer tub suspended elastically in a cabinet, (c) an inner tub having a rotating shaft and sustained rotatably in the outer tub, (d) an agitator disposed rotatably on an inner bottom of the inner tub, (e) a motor for driving at least one of the inner tub and the agitator, (f) a warm-air blowing section for blowing warm air into the inner tub, (g) a water supplying section for supplying water into the inner tub, (h) a warm-air circulating pass, which has a heat exchanger, for circulating the warm air supplied from said warm-air blowing section, (i) a cooling section for cooling the heat exchanger, and (j) a controller for controlling sections including the motor, the warm-air blowing section and the cooling section, and controlling processes including washing, rinsing, dehydrating and drying, where the cooling section is formed of a water-cooling section, which cools the warm air in the heat exchanger by supplying water, and an air-cooling section, which cools an outer wall of the heat exchanger by blowing air.

BRIEF DESCRIPTION OF THE DRAWINGS

FIG. 4-1 shows timing charts explaining a drying process of the washing-drying machine in accordance with a third exemplary embodiment of the present invention.

FIG. 4-2 shows other timing charts explaining a drying process of the washing-drying machine in accordance with the third exemplary embodiment of the present invention.

DETAILED DESCRIPTION OF THE INVENTION

A washing-drying machine of this invention is demonstrated hereinafter with reference to the accompanying drawings. In these drawings, the same elements as a conventional washing-drying machine discussed above have the same reference marks.

First Embodiment

Figure 1:
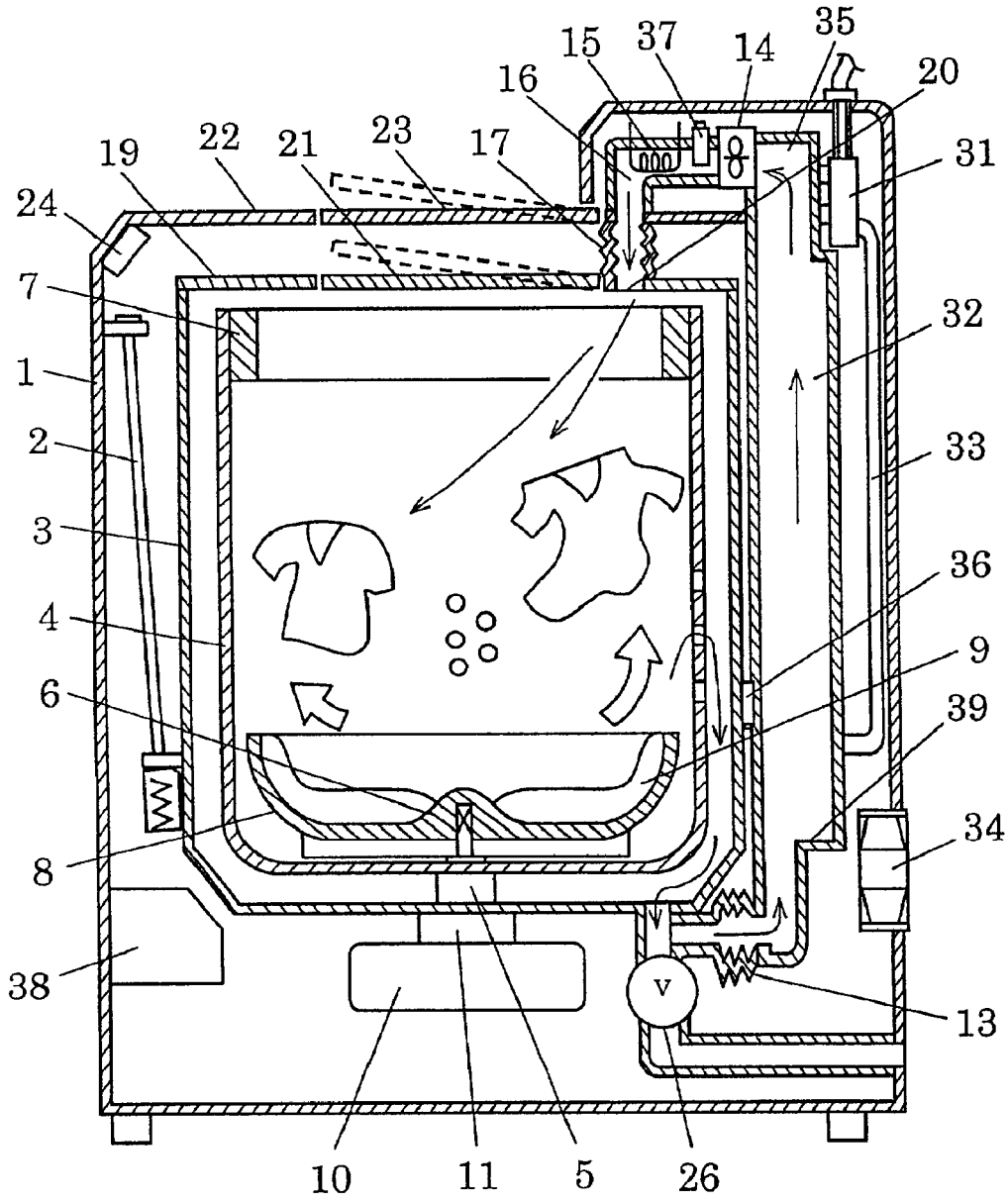
FIG. 1 shows a vertical longitudinal sectional view of a washing-drying machine in accordance with a first exemplary embodiment of the present invention.

FIG. 1 is a sectional view showing a structure of the washing-drying machine in accordance with the first exemplary embodiment of the present invention.

As shown in FIG. 1, outer tub 3 is elastically suspended using a plurality of suspensions 2 and placed in cabinet 1, so that cabinet 1 absorbs vibration by using suspension 2 during a dehydrating process. Inner tub 4 used for accommodating clothes (articles for washing or drying) is disposed in outer tub 3, and can rotate about the center of shaft 5 for washing and spin-drying (dehydrating). Cabinet 1 has a double structure having a space between tub 3 and tub 4. Agitator 6 is disposed on the inner bottom of inner tub 4 rotatably, and agitates the clothes (articles for washing or drying). A plurality of small holes (not shown) are punched on an inner wall of inner tub 4, and fluid balancer 7 is disposed on an upper part of inner tub 4. Protrusion 9 for agitating is formed on a dishlike base having slope 8 at its circumference, whereby agitator 6 is formed. Articles for drying are raised along slope 8 by using centrifugal force of agitator 6 during a drying process.

Motor 10 is disposed under outer tub 3 and coupled with inner tub 4 or agitator 6 via clutch 11 and shaft 5, where clutch 11 switches rotating force and transmits the force to shaft 5.

Outer tub cover 19 for covering an upper surface of outer tub 3 air-tightly is disposed on an upper surface of outer tub 3, and warm-air-spouting opening 20, which is connected with elastic upper-accordion-hose 17, is punched on cover 19. Inner lid 21 used for putting in or taking out the clothes is formed on cover 19. Cabinet cover 22 for covering an upper surface of cabinet 1 has outer lid 23 and operational display section 24. Drain valve 26 for draining water from outer tub 3 is disposed on the bottom of outer tub 3.

Water valve 31 is used as a water valve for washing, which supplies water into inner tub 4 at a washing and a rinsing process, and a water valve for cooling water, which is supplies water into heat exchanger 32 at a drying process. Water is supplied into heat exchanger 32 through hose 33, where water valve 31 and hose 33 form a water-cooling section for cooling heat exchanger 32, and air blower 34 for cooling a surface of heat exchanger 32 forms an air-cooling section.

Heat exchanger 32 is used for dehumidifying warm air circulating. One end of heat exchanger 32 is coupled with a lower part of outer tub 3 via elastic lower-accordion-hose 13, and another end of heat exchanger 32 is coupled with one end of air blower 14 for drying. Another end of air blower 14 is coupled with warm-air supplying pass 16 having heater 15 (heating unit), and pass 16 leads to inner tub 4 via upper-accordion-hose 17. As a result, warm air is circulated through warm-air circulating pass 35 in the washing machine, where warm-air circulating pass 35 is formed by the hoses, the pass and so on. Air blower 14 and heater 15 form a warm-air blowing section.

Thermistor 36 detects a temperature of an outer wall of heat exchanger 32, and thermistor 37 detects a temperature of circulating air at an exit of heat exchanger 32, where thermistor 36 is disposed on the outer wall of heat exchanger 32.

Controller 38 (control section), which includes a microprocessor, controls motor 10 (driving means), clutch 11, air blower 14 for drying (warm-air blowing section), heater 15 (warm-air blowing section), drain valve 26, water valve 31, air blower 34 for cooling and so on, thereby controls processes i.e., washing, rinsing, dehydrating and drying.

Besides, controller 38 finishes the drying process by calculating a difference of temperatures between a temperature of circulating air in warm-air circulating pass 35 and a temperature of the outer wall of heat exchanger 32, where these temperatures are detected by thermistor 36 and thermistor 37.

An operation of the washing-drying machine of this invention is described hereinafter. In a washing process, outer lid 23 and inner lid 21 are opened, and clothes (articles for washing) are placed into inner tub 4, then the operation starts. After water valve 31 opens, and water is supplied to a given water level, motor 10 drives. At that time, motive power from motor 10 is transmitted to agitator 6 by using clutch 11 of a transmitting section via the shaft for washing. Because agitator 6 is rotated, protrusion 9 agitates clothes, and washing is executed by using power of water flows and power produced from contact between clothes each other or between clothes and inner tub 4 or agitator 6.

After the washing process, water in inner tub 4 is drained by opening drain valve 26 in a dehydrating process. Clutch 11 of the transmitting section are shifted to a dehydration side, and motive power from motor 10 is transmitted to inner tub 4 via the shaft for spin-drying (shaft for dehydrating). As a result, inner tub 4 rotates, and centrifugal force works on the clothes, then water is separated from the clothes. After the dehydrating process, the drying process starts.

In the drying process, clutch 11 are shifted to a washing side, and motive power from motor 10 is transmitted to agitator 6. Clothes, which are adhered on the inner wall of inner tub 4 after the dehydrating process, are removed by rotating agitator 6 clockwise and counter-clockwise. When protrusion 9 agitates the clothes by rotating agitator 6 clockwise and counter-clockwise, warm air is sent to warm-air-spouting opening 20 using warm-air blowing section formed of air blower 14 and heater 15. Warm air blown from opening 20 to inner tub 4 causes water to evaporate from the clothes, and the warm air moves from inner tub 4 to an inside of outer tub 3, then moves through lower-accordion-hose 13 and reaches heat exchanger 32.

The warm air, which took water away from the clothes and became high humidity, exchanges its own heat by a wall of heat exchanger 32 using blowing wind from air blower 34, when the warm air moves through heat exchanger 32. After that, the warm air reaches at a moisture condensation point, and forms moisture condensation on an inner wall of heat exchanger 32.

At that time, cooling water (city water) is supplied from water valve 31 to heat exchanger 32 via hose 33 by 0.4 liter per minute. The cooling water supplied into heat exchanger 32 hits step 39 and is reflected as sprays. When the warm air of high humidity hits the sprays, the warm air is cooled down and exchanges its own heat, and then forms moisture condensation. The moisture condensation and the cooling water are drained out of cabinet 1 via drain valve 26.

As discussed above, the warm air of high humidity exchanges its own heat by air-cooling method, which is worked in heat exchanger 32 by air blower 34, and water-cooling method, which is worked by cooling water supplied from hose 33. As a result, the warm air is dehumidified, and returns to air blower 14 for drying. The clothes in inner tub 4 are dried by circulating the warm air in warm-air circulating pass 35.

Figure 2:
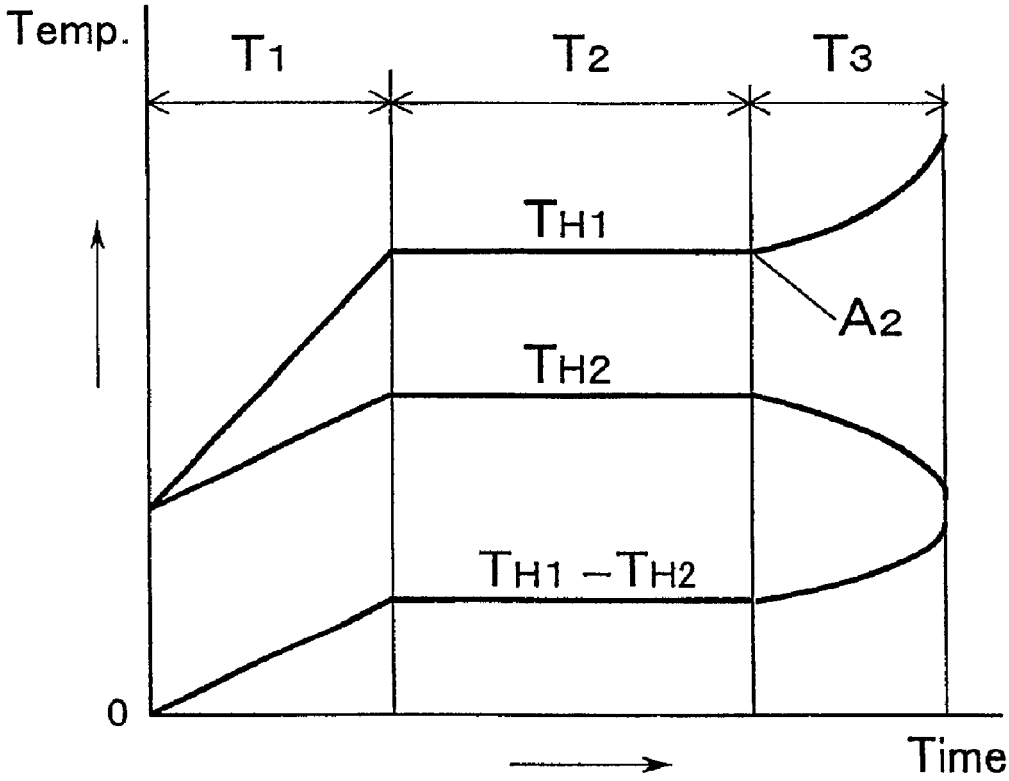
FIG. 2 shows a timing chart explaining a drying process of the washing-drying machine in accordance with the first embodiment of the present invention.

FIG. 2 shows a temperature change of circulating wind during the drying process, namely, shows temperature TH1 detected by thermistor 37, temperature TH2 detected by thermistor 36 and temperature TH1−TH2 (a difference of temperatures between temperature TH1 and temperature TH2). A change of a condition of warm-air circulating pass 35 during the drying process is explained hereinafter with reference to FIG. 2.

Firstly, when drying starts, a temperature of the clothes exposed to warm air increases during preheat period T1.

Secondly, the amount of evaporated water from clothes keeps constant (referred to as a state of equilibrium) during constant-rate period T2 of drying. Cooling effect by the air-cooling method and the water-cooling method is spent for a change of a state i.e., condensation, and a temperature of a side wall of heat exchanger 32 keeps the state of equilibrium. Therefore temperature TH2 of thermistor 36 for detecting a temperature of an inner wall of heat exchanger 32 also keeps constant.

Thirdly, when drying progresses, evaporating water from clothes gradually decreases, and the temperature of warm wind increases at decreasing rate period T3 of drying. In this case, because a relative humidity (the amount of water) of the warm wind decreases gradually, exchanging heat spent for condensation at heat exchanger 32 also decreases. The side wall of heat exchanger 32 is cooled by the air-cooling method, which is worked in heat exchanger 32 by air blower 34, and the water-cooling method, which is worked by cooling water supplied from hose 33. As a result, a temperature of the side wall of heat exchanger 32 decreases.

A change of a state at the side wall of heat exchanger 32 is detected by thermistor 36, namely, temperature TH2 is detected by thermistor 36. Temperature TH1 of circulating wind from period T2 to period T3 is detected by thermistor 37, and a difference of temperatures between temperature TH1 and temperature TH2 is calculated. As a result, inflection point A2 shown in FIG. 2 can be determined definitely. A given delayed period is provided after inflection point A2 and clothes are enough dried, and then the drying process finishes.

The washing-drying machine of this invention uses the air-cooling method worked by air blower 34 and the water-cooling method worked by cooling water supplied from hose 33. As a result, the washing-drying machine can improve cooling effect of heat exchanger 32, thereby dehumidify the clothes efficiently, namely, dry the clothes sufficiently.

As discussed above, in this invention, clothes are dehumidified, namely, dried, because high humidity warm air circulated in warm-air circulating pass 35 is cooled using the air-cooling method worked by air blower 34 and the water-cooling method worked by cooling water supplied from hose 33. The clothes can be also dehumidified using either the air-cooling method or the water-cooling method, or using both the air-cooling method and the water-cooling method. In this case, at least one of cooling methods can be operated or not operated at an arbitrary time during the drying process. As a result, the effective cooling method can be selected according to a condition of the drying process, and high dehumidification (drying) is obtained.

Second Embodiment

A structure of a washing-drying machine in accordance with the second exemplary embodiment of the present invention is approximately the same as that of the first embodiment as shown in FIG. 1. The elements similar to those shown in the first embodiment have the same reference marks, and the descriptions of those elements are omitted here.

Figure 3:
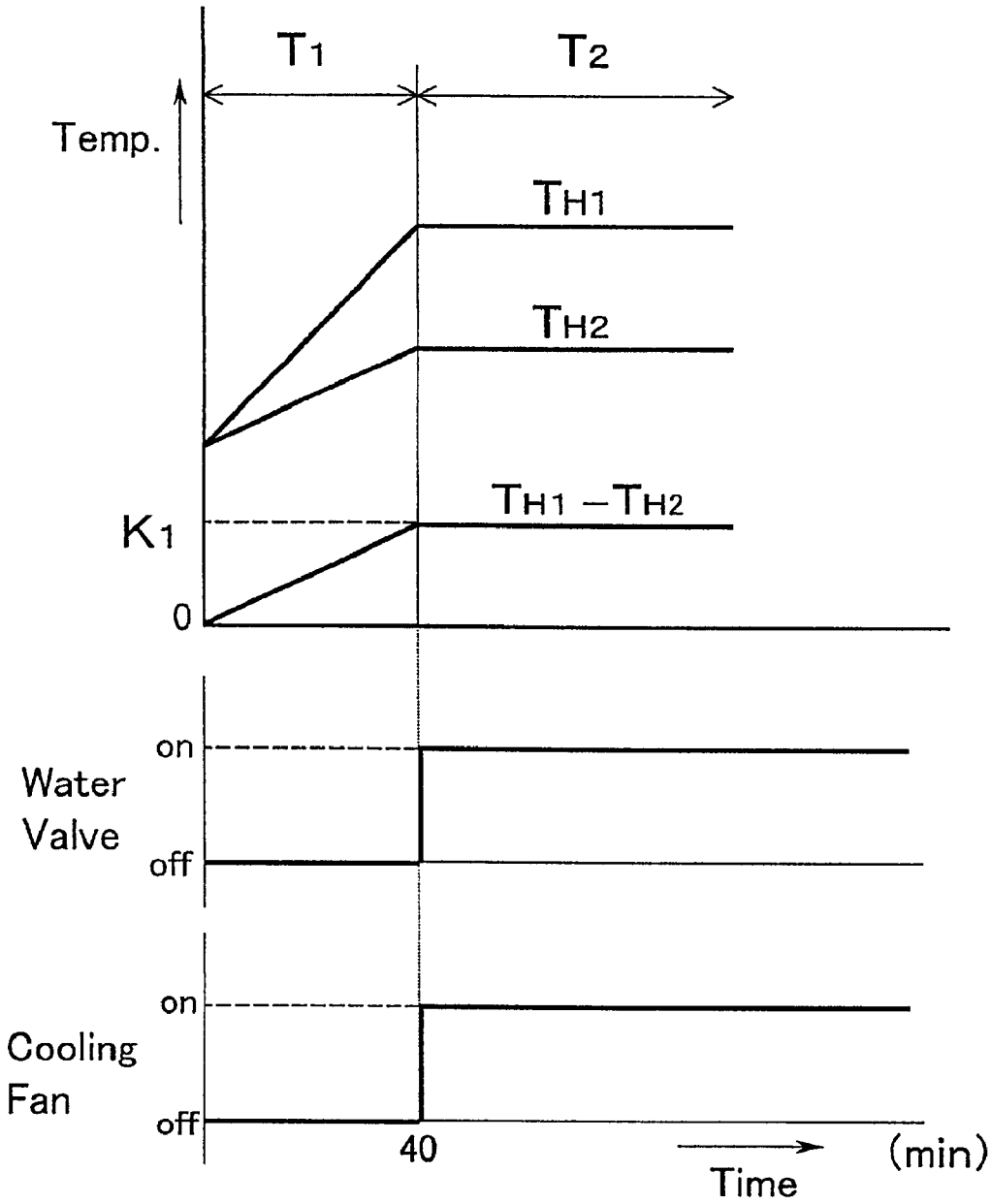
FIG. 3 shows timing charts explaining a drying process of the washing-drying machine in accordance with a second exemplary embodiment of the present invention.

At the washing-drying machine in the second embodiment of this invention, controller 38 (control section) operates according to a temperature change (as shown in an upper part of FIG. 3) of circulating wind in a drying process. A lower part of FIG. 3 shows timing charts of air blower 34 and water valve 31. As shown in FIG. 3, a preheat period is defined as a given period, e.g., 40 minutes, from a starting time of drying or as a period till temperature TH1–TH2 (a difference between temperature TH1 and temperature TH2) reaches a given value (as shown in K1 of FIG. 3). Temperature TH1 (a temperature of circulating wind in warm-air circulating pass. 35) is detected by thermistor 37, and temperature TH2 (a temperature of an outer wall of heat exchanger 32) is detected by thermistor 36. During the preheat period, an air-cooling method worked by air blower 34 and a water-cooling method worked by cooling water supplied from water valve 31 through hose 33 are stopped. After that, heat exchanger 32 is cooled using either the air-cooling method or the water-cooling method, or using both the air-cooling method and the water-cooling method. FIG. 3 shows an example that heat exchanger 32 is cooled using both the air-cooling method and the water-cooling method. The structure and the operation discussed above are features of the washing-drying machine in the second embodiment of this invention, and other structures are approximately the same as those of the first embodiment.

FIG. 3 shows temperature TH1 detected by thermistor 37, temperature TH2 detected by thermistor 36 and temperature TH1–TH2 (the difference of temperatures between temperature TH1 and temperature TH2). In a first stage of the drying process (preheat period TH1), most of heat energy of warm air heated by heater 15 is spent for a temperature rise of the clothes or tub. As a temperature of a surface of the clothes increases, water is evaporated. After that, the heat energy of warm air and latent heat of evaporating water are balanced, and achieve a state of equilibrium at period T2. In other words, the state of equilibrium (constant-rate period of drying) can be achieved fast by not cooling heat exchanger 32 at the early stage of the drying process, where the amount of evaporating water becomes maximum at the state of equilibrium.

In the washing-drying machine of the second embodiment of this invention, both air blower 34 and water valve 31 are stopped during the preheat period (during the given period from the starting time of drying). However, drying can work by stopping at least one of air blower 34 and water valve 31.

In the washing-drying machine of the second embodiment of this invention, when cooling water supplied from water valve 31 through hose 33 is stopped by trouble in the drying process, the air-cooling method by air blower 34 can be operated instead of the water-cooling method. In this case, when the cooling water is stopped, a temperature of the circulating wind rises suddenly. At that time, the temperature is detected by thermistor 37, and then air blower 34 is operated. This operation discussed above can prevent the clothes from over drying or not drying, even if the cooling water is stopped by trouble of water valve 31 or hose 33.

Third Embodiment

A structure of a washing-drying machine in accordance with the third exemplary embodiment of the present invention is approximately the same as that of the first embodiment as shown in FIG. 1. The elements similar to those shown in the first embodiment have the same reference marks, and the descriptions of those elements are omitted here.

In the washing-drying machine of the third embodiment of this invention, controller 38 (control section) operates according to a temperature change (as shown in an upper part of FIG. 4-1) of circulating wind in a drying process. A lower part of FIG. 4-1 shows timing charts of air blower 34 for cooling and water valve 31. As shown in FIG. 4-1, a period is defined as a given constant-rate period of drying, e.g., 80 minutes (120 min.–40 min.), from a starting time of drying after a preheat period, e.g., 40 minutes. In other words, the period is defined as a constant-rate period of drying while temperature TH1–TH2 (a difference of temperatures between temperature TH1 and temperature TH1) keeps a given value (as shown in K2 of FIG. 4-1). Temperature TH1 (a temperature of circulating wind in warm-air circulating pass 35) is detected by thermistor 37, and temperature TH2 (a temperature of an outer wall of heat exchanger 32) is detected by thermistor 36. During the constant-rate period of drying, heat exchanger 32 is cooled using an air-cooling method worked by air blower 34 and a water-cooling method worked by cooling water supplied from water valve 31 through hose 33. After that, during a period from a rise of temperature TH1–TH2 to an end of drying (a decreasing rate period T3 of drying), the water-cooling method worked by cooling water supplied through hose 33 is stopped, and only the air-cooling method worked by air blower 34 is operated. The structure and the operation discussed above are features of the washing-drying machine in the third embodiment of this invention, and other structures are approximately the same as those of the first embodiment.

During the constant-rate period T2 of drying, humidity in heat exchanger 32 is approximately 100%, and the amount of heat of circulating wind becomes maximum, so that strong cooling effect is required for cooling heat exchanger 32, for taking away heat and condensing water. After that, the humidity of the circulating wind falls down, and the cooling water begins to evaporate again during the decreasing rate period T3 of drying.

In other words, during the constant-rate period T2 of drying, heat exchanger 32 is dehumidified effectively using the air-cooling method worked by air blower 34 and the water-cooling method worked by cooling water supplied from water valve 31 through hose 33, so that a high cooling capacity is obtained. During the decreasing rate period T3 of drying, only the air-cooling method by air blower 34 is operated, so that the amount of re-evaporation decreases, and the clothes are dried completely within appropriate time.

At the washing-drying machine in the third embodiment of this invention, as discussed above, the water-cooling method worked by cooling water supplied through hose 33 is stopped, and only the air-cooling method worked by air blower 34 is operated during the decreasing rate period T3 of drying. However, this invention is not restricted the structure above mentioned. For example, as shown in FIG. 4-2, heat exchanger 32 can be cooled using the only the water-cooling method worked by cooling water supplied through hose 33 and not using the air-cooling method worked by air blower 34 during the decreasing rate period T3 of drying. Besides that, heat exchanger 32 can be cooled by selecting arbitrarily either air-cooling method worked by air blower 34 or water-cooling method worked by cooling water supplied through hose 33.

At the washing-drying machine of this invention, as shown in FIG. 4-1 or FIG. 4-2, the air-cooling method worked by air blower 34 or the water-cooling method worked by cooling water supplied from water valve 31 through hose 33 can be selected arbitrarily during the decreasing rate period T3. When the air-cooling method worked by air blower 34 is selected, the clothes become fluffy after drying. When the water-cooling method worked by cooling water supplied from water valve 31 through hose 33 is selected, the clothes are not dried out overly, because excessive falling of humidity is prevented by the cooling water. Condition of dried clothes suited user's taste can be obtained by selecting the air-cooling method or the water-cooling method during the decreasing rate period T3 of drying.

At the washing-drying machine in the third embodiment of this invention, even if the cooling water is stopped by trouble, the air-cooling method by air blower 34 can operate in stead of the water-cooling method. This operation is the same as that of second embodiment.

Fourth Embodiment

A structure of a washing-drying machine in accordance with the fourth exemplary embodiment of the present invention is approximately the same as that of the first embodiment as shown in FIG. 1. The elements similar to those shown in the first embodiment have the same reference marks, and the descriptions of those elements are omitted here.

Figure 5:
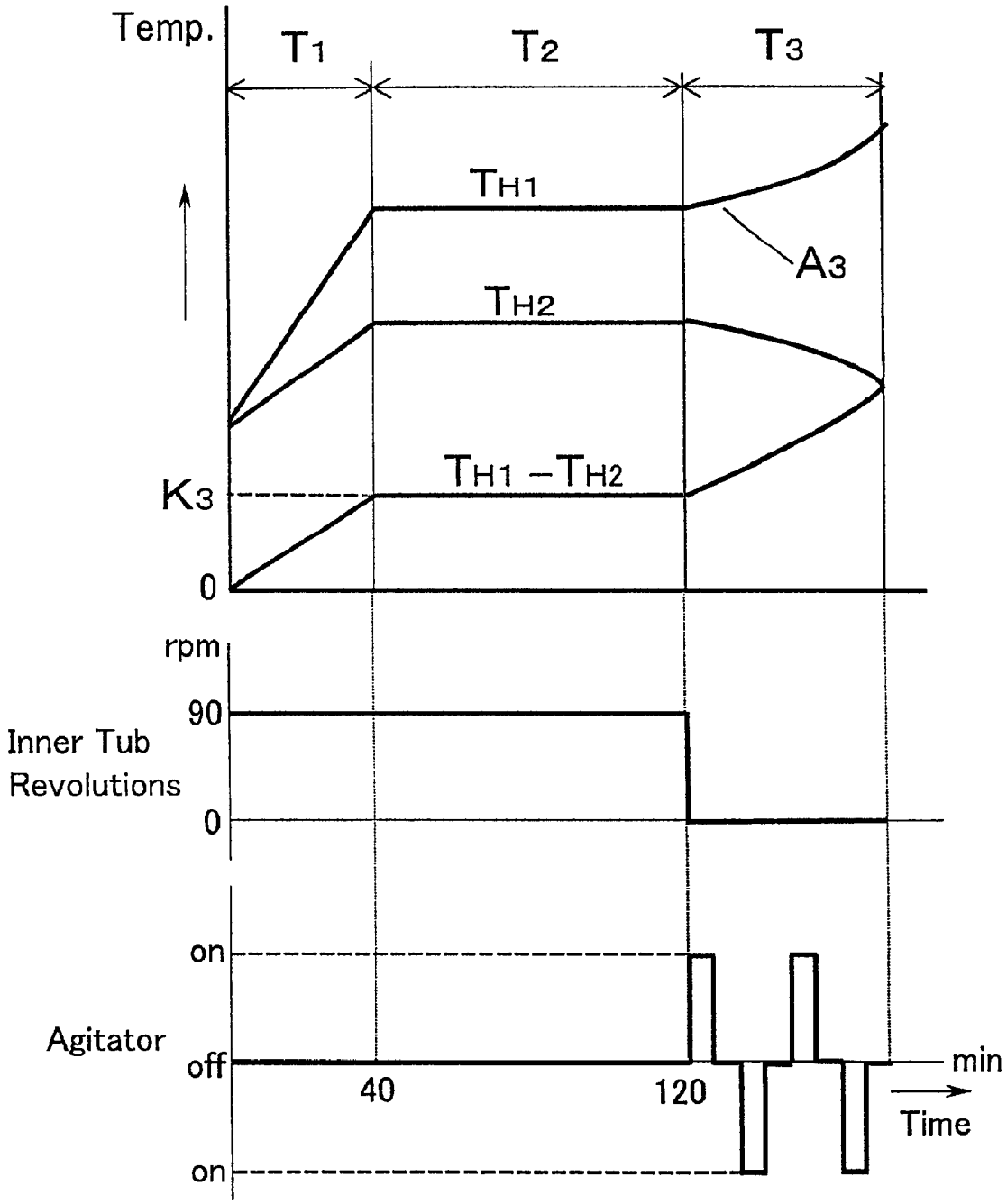
FIG. 5 shows timing charts explaining a drying process of the washing-drying machine in accordance with a fourth exemplary embodiment of the present invention.

At the washing-drying machine in the fourth embodiment of this invention, controller 38 (control section) operates according to a temperature change (as shown in an upper part of FIG. 5) of circulating wind in a drying process. A lower part of FIG. 5 shows timing charts of number of revolutions of inner tub 4 and agitator 6. As shown in FIG. 5, period T2 is defined as a given constant-rate period of drying, e.g., 80 minutes (120 min.–40 min.), from a starting time of drying after a preheat period, e.g., 40 minutes. In other words, period T2 is defined as a constant-rate period of drying while temperature TH1–TH2 (a difference of temperatures between temperature TH1 and temperature TH2) keeps a given value (as shown in K3 of FIG. 5). Temperature TH1 (a temperature of circulating wind in warm-air circulating pass 35) is detected by thermistor 37, and temperature TH2 (a temperature of an outer wall of heat exchanger 32) is detected by thermistor 36. During preheat period T1 and constant-rate period T2 of drying, inner tub 4 is rotated at a given revolution, e.g., 90 rpm. After that, during decreasing rate period T3 of drying (a period from a rise of temperature TH1–TH2 to an end of drying), agitator 6 is rotated. The structure and the operation discussed above are features of the washing-drying machine in the fourth embodiment of this invention, and other structures are approximately the same as those of the first embodiment.

During a given time, e.g., 120 minutes, from the starting point of drying or during the constant-rate period of drying, the clothes in inner tub 4 contain water and become heavy, so that agitating the clothes by rotating agitator 6 is difficult. If inner tub 4 is not rotated in the drying process, twists of the clothes occur, and wrinkles tend to occur after the drying process. To prevent the twist of the clothes, inner tub 4 is rotated at a given revolution, e.g., 90 rpm in the drying process.

After a given period, e.g., 120 minutes, from the starting time of drying, a drying rate of the clothes becomes approximately 90% through 95% in an early stage of the decreasing rate period of drying. At that time, agitator 6 is operated, whereby clothes are raised and agitated by rotating agitator 6, and dried evenly. A lower part of FIG. 5 shows an example of the agitator rotating normally and inversely at every given period.

At the washing-drying machine in the first through fourth embodiments of this invention, cooling water supplied through hose 33 can be controlled by controller 38 (control section) using water valve 31 in the drying process. As a result, cooling water can be supplied or not supplied at a given period. For example, cooling water is supplied for 5 seconds and not supplied for 10 seconds.

When cooling water is supplied intermittently (for example, water is not supplied for 10 seconds), sprays of the cooling water are retained in the heat exchanger for a while, so that warm air is dehumidified effectively. In general, a conventional heat exchanger of a water-cooling type needs a great amount of cooling water, and the water is not effectively used for dehumidification. The washing-drying machine of this invention solves the problems discussed above, and can save the amount of water.

Controller 38 (control section) of the washing-drying machine of this invention can have a function for detecting the amount of clothes in inner tub 4. In this case, when controller 38 detects that weight of the clothes is not more than a given weight, air capacity of warm air can be increased more than a given capacity using the warm-air blowing section formed of air blower 14 and heater 15. For example, when the clothes is not more than 2 kg for rated capacity 4.5 kg, air capacity of warm air is increased by 30%.

An operation of the washing-drying machine having the function discussed above is described hereinafter. Clothes are put in inner tub 4, and then controller 38 rotates agitator 6 by driving motor 10 before water is supplied in the washing process. After motor 10 is stopped, the amount of the clothes in inner tub 4 is detected by measuring variation of inert revolution of motor 10. When the function detects that the amount of clothes is a little, e.g., not more than 2 kg, air capacity of warm air is increased, e.g., increased by 30%, by increasing revolution of air blower 14 in the drying process. As a result, a drying time is substantially shortened, e.g., shortened approximately by 30%, so that the washing-drying machine becomes more convenient.

Figure 6:
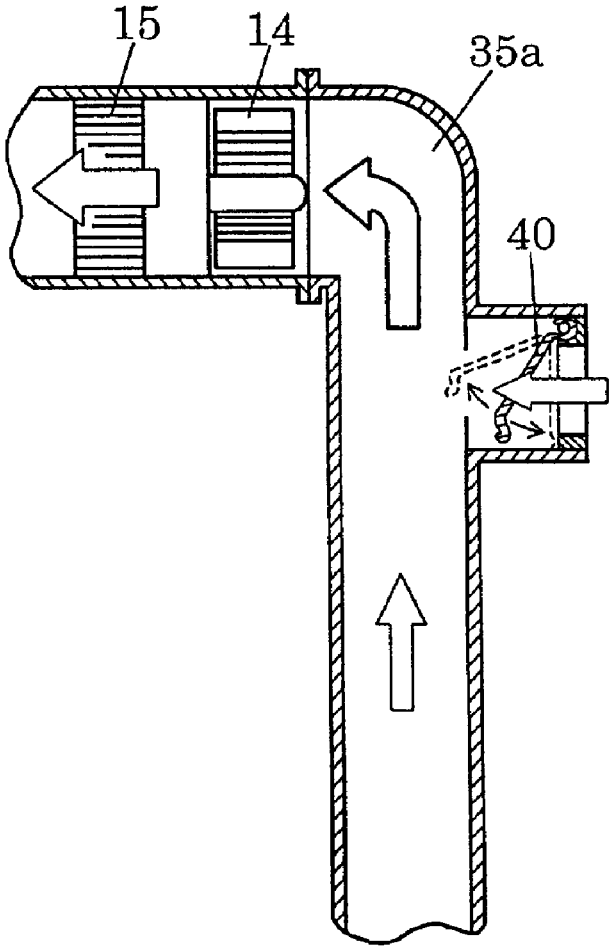
FIG. 6 shows a sectional view of an essential part of a warm-air circulating pass in the washing-drying machine in accordance with the embodiment of the present invention.
Figure 7:
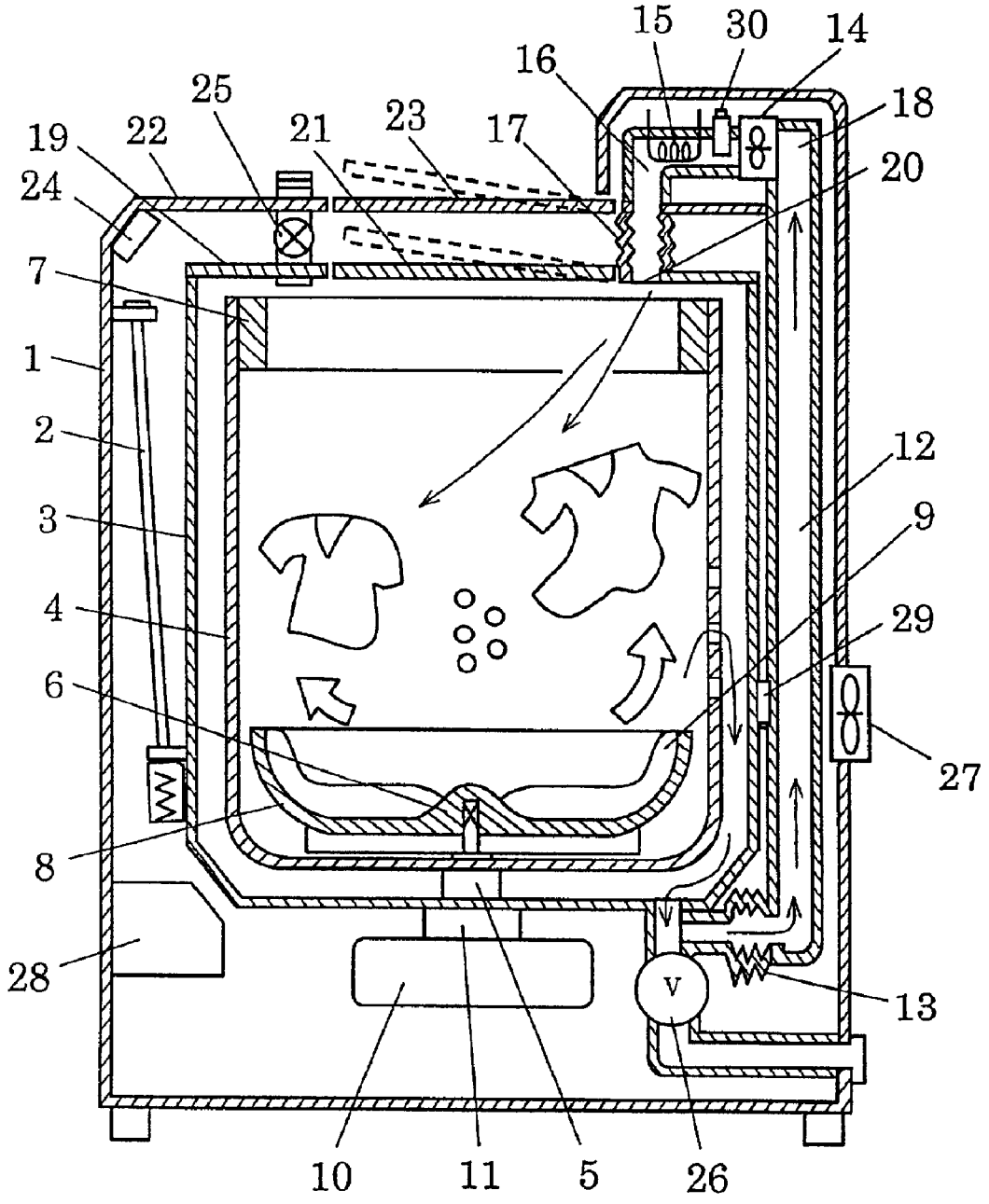
FIG. 7 PRIOR ART
FIG. 7 shows a vertical longitudinal sectional view of a conventional washing-drying machine.
Figure 8:
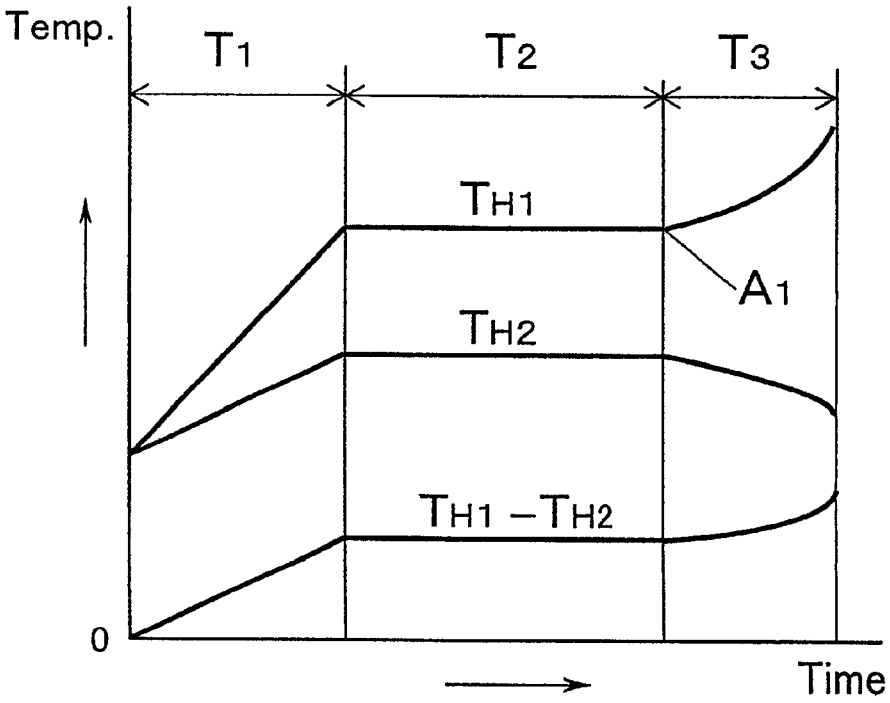
Fig.8 Prior Art
FIG. 8 shows a timing chart explaining a drying process of the conventional washing-drying machine.

As shown in FIG. 6, at the washing-drying machine in the embodiments of this invention, valve 40 can be placed at warm-air circulating pass 35*a* for circulating warm air. As a result, an arbitrary opening (from complete close to full open) can be obtained using valve 40 according to variation of circulating wind in warm-air circulating pass 35*a*.

An operation of the washing-drying machine having valve 40 discussed above is described hereinafter. When controller 38 detects that the amount of clothes is a little, e.g., not more than 2 kg, air capacity of warm air is increased, e.g., increased by 30%, by increasing revolution of air blower 14 in the drying process. At that time, controller 38 allows valve 40 to open, so that dried outer air is introduced to warm-air circulating pass 35*a*. As a result, drying efficiency is improved and a drying time is substantially shortened, so that the washing-drying machine becomes more convenient.

As discussed above, the washing-drying machine of this invention includes the following elements:

(a) a cabinet, (b) an outer tub suspended elastically in a cabinet, (c) an inner tub having a rotating shaft vertically and sustained rotatably in the outer tub, (d) an agitator disposed rotatably on an inner bottom of the inner tub, (e) a motor for driving the inner tub or the agitator, (f) a warm-air blowing section for blowing a warm air into the inner tub, (g) a water supplying section for supplying water into the inner tub, (h) a warm-air circulating pass, which has a heat exchanger, for circulating the warm air supplied from said warm-air blowing section, (i) at least one of cooling section for cooling the heat exchanger, and (j) a controller for controlling sections including the motor, the warm-air blowing section and the cooling section, and controlling processes including washing, rinsing, dehydrating and drying, where the cooling section is formed of a water-cooling section, which cools the warm air in the heat exchanger by supplying water, and an air-cooling section, which cools an outer wall of the heat exchanger by blowing air.

According to this structure, the washing-drying machine of this invention has following features:

(a) high dehumidification rate by improving heat-exchange efficiency of a heat exchanger, (b) high efficiency by shortening drying time and improving drying efficiency, (c) approximately free from damage to clothes, and (d) high reliability by decreasing moisture condensation using circulating wind drained partly from an outer tub of the washing-drying machine.

What is claimed is:

1. A washing-drying machine operable to wash, rinse, dehydrate and dry objects, said washing-drying machine comprising:

a cabinet;

an outer tub suspended elastically in said cabinet;

an inner tub having a rotating shaft and a bottom, said inner tub being rotatably sustained in said outer tub;

an agitator disposed rotatably on said bottom of said inner tub;

a motor operable to drive at least one of said inner tub and said agitator;

a warm-air blowing section operable to blow warm air into said inner tub;

a water supplying section operable to supply water into said inner tub;

a warm-air circulating pass operable to circulate the warm air supplied from said warm-air blowing section, said warm-air circulating pass comprising a heat exchanger having an outer wall;

a cooling section operable to cool the heat exchanger, said cooling section comprising a water-cooling section that is capable of supplying water for cooling the warm air in said heat exchanger and an air-cooling section that is capable of blowing air for cooling said outer wall of said heat exchanger; and a controller for controlling said motor, said warm-air blowing section and said cooling section, and for controlling processes including washing, rinsing, dehydrating and drying, wherein said controller controls said water-cooling section and said air-cooling section during a first period, wherein the first period is one of a given period after a preheat period in a drying process and a constant-rate period of drying while a difference of temperatures between a temperature of the warm air in said warm-air circulating pass and a temperature of said outer wall of said heat exchanger maintains a given value; and wherein said controller only controls said air-cooling section during a decreasing rate period, wherein the decreasing rate period is a period from when a difference of temperatures between a temperature of the warm air in said warm-air circulating pass and a temperature of said outer wall of said heat exchanger exceeds the given value to an end of the drying process.

2. The washing-drying machine as claimed in claim 1, wherein said controller stops at least one of said water-cooling section and said air-cooling section during a second period, wherein the second period is one of a given period including a starting time of the drying process and the preheat period that ends when the difference of temperatures between the temperature of the warm air in said warm-air circulating pass and the temperature of said outer wall of said heat exchanger reaches the given value.

3. The washing-drying machine as claimed in claim 1, wherein said controller controls said water-cooling section to operate at a predetermined time and for a predetermined time interval.

4. The washing-drying machine as claimed in claim 1, wherein said controller controls one of said water-cooling section and said air-cooling section to operate when the other one of said water-cooling section and said air-cooling section is malfunctioning.

5. The washing-drying machine as claimed in claim 1, wherein said controller controls said inner tub to rotate at a given revolution during the first period, and wherein said controller controls said agitator to rotate during the decreasing rate period of drying.

6. The washing-drying machine as claimed in claim 1, wherein said controller detects a total weight of objects in said inner tub; and wherein said controller controls said warm-air blowing section to increase air capacity more than a given capacity when said controller detects that the total weight of the objects is not more than a given weight.

7. The washing-drying machine as claimed in claim 1, further comprising:

a valve disposed in said warm-air circulating pass, wherein said controller controls said valve to open and close based on a variation of warm air in said warm-air circulating pass.

8. The washing-drying machine as claimed in claim 2, wherein said controller controls said water-cooling section to operate at a predetermined time and for a predetermined time interval.

9. The washing-drying machine as claimed in claim 2, wherein said controller controls one of said water-cooling section and said air-cooling section to operate when the other one of said water-cooling section and said air-cooling section is malfunctioning.

10. The washing-drying machine as claimed in claim 2, wherein said controller controls said inner tub to rotate at a given revolution during the first period, and wherein said controller controls said agitator to rotate during the decreasing rate period of drying.

11. The washing-drying machine as claimed in claim 2, wherein said controller detects a total weight of objects in said inner tub; and wherein said controller controls said warm-air blowing section to increase air capacity more than a given capacity when said controller detects that the total weight of the objects is not more than a given weight.

12. The washing-drying machine as claimed in claim 2, further comprising:

a valve disposed in said warm-air circulating pass, wherein said controller controls said valve to open and close based on a variation of warm air in said warm-air circulating pass.

* * * * *